US009370822B2

(12) United States Patent
Boni et al.

(10) Patent No.: US 9,370,822 B2
(45) Date of Patent: Jun. 21, 2016

(54) VACUUM DIE-CASTING MACHINE

(71) Applicant: IDRA S.R.L., Travagliato (IT)

(72) Inventors: Roberto Boni, Travagliato (IT); Florenzo Dioni, Travagliato (IT); Werner Hoefer, Remshalden (DE); Rainer Gary, Remshalden (DE)

(73) Assignee: IDRA S.R.L., Travagliato (IT)

( * ) Notice: Subject to any disclaimer, the term of this patent is extended or adjusted under 35 U.S.C. 154(b) by 153 days.

(21) Appl. No.: 13/952,610

(22) Filed: Jul. 27, 2013

(65) Prior Publication Data

US 2014/0027081 A1 Jan. 30, 2014

Related U.S. Application Data

(63) Continuation-in-part of application No. PCT/EP2011/000376, filed on Jan. 28, 2011.

(51) Int. Cl.

| | |
|---|---|
| ***B22D 17/14*** | (2006.01) |
| ***B22D 17/04*** | (2006.01) |
| ***B22D 18/08*** | (2006.01) |
| ***B22D 17/32*** | (2006.01) |

(52) U.S. Cl.

CPC ..... *B22D 18/08* (2013.01); *B22D 17/14* (2013.01); *B22D 17/32* (2013.01); *B22D 17/04* (2013.01)

(58) Field of Classification Search

CPC ..... B22D 17/02; B22D 17/04; B22D 17/06; B22D 17/08; B22D 17/14; B22D 17/32

USPC ..... 164/4.1, 61–65, 113, 316–318; 700/146

See application file for complete search history.

(56) References Cited

U.S. PATENT DOCUMENTS

| | | | | |
|---|---|---|---|---|
| 4,476,911 | A | 10/1984 | Lossack et al. | |
| 5,246,055 | A * | 9/1993 | Fields et al. | 164/61 |
| 6,953,079 | B2 * | 10/2005 | Suzuki et al. | 164/267 |
| 7,399,436 | B2 * | 7/2008 | Tsuji et al. | 264/40.1 |

FOREIGN PATENT DOCUMENTS

| | | |
|---|---|---|
| EP | 0 790 090 | 8/1997 |
| JP | 2004 154825 | 6/2004 |

* cited by examiner

*Primary Examiner* — Kevin E Yoon
(74) *Attorney, Agent, or Firm* — Klaus J. Bach

(57) ABSTRACT

In a vacuum-die casting machine comprising a casting mold having stationary and movable mold halves defining therebetween a mold cavity, a casting chamber which is in communication with the mold cavity and includes a piston and an evacuation arrangement connectable to the casting chamber for drawing melt from a melt storage into the casting chamber, a control arrangement is provided for controlling the mold cavity pressure depending on the pressure difference between the mold cavity and a cavity pressure and a counter pressure of the metal melt.

5 Claims, 3 Drawing Sheets

VACUUM DIE-CASTING MACHINE

This is Continuation-in-Part application of pending international patent application PCT/EP2011/000376 filed Jan. 28, 2011.

BACKGROUND OF THE INVENTION

The invention resides in a vacuum die-casting machine which includes a mold with two mold halves forming therebetween a cavity which is in communication with a casting chamber to which molten metal is supplied from a holding oven.

EP 0 790 090 discloses a vacuum die casting machine. which comprises a casting mold formed by two mold halves for receiving a metal melt. One of the mold halves is stationary and the second mold half is movable in the direction toward the stationary mold half. One of the mold halves is provided with a seal rope at the front edge thereof which extends between the mold halves so as to form a pressure-tight seal between the two mold halves. The casting cavity between the two mold halves is in communication with a casting chamber in which A casting piston is movably supported. The casting chamber is connected via an intake ripe to a warm-holding oven in Which a metal melt is contained. The casting cavity between the mold halves which forms the casting chamber is connected is na intake, pipe to a warm-holding oven in which a metal melt is contained. The casting cavity between the mold halves which forms the casting mold is connected to an evacuation arrangement for generating a vacuum which results in drawing metal melt out of the warm holding oven via the intake line into the casting chamber.

During the procedure of closing the mold halves, care must be taken that no gas from the mold cavity enters the metal melt via the casting chamber and the intake pipe since this would result in undesirable gas inclusions in the melt and a deterioration of the quality of the work piece being cast. In accordance with EP 6 790 090 B1, in order to avoid gas flow into the warm-holding oven during the closing process, the casting piston is used as blocking valve and is moved into a position in which the communication connection with the warm holding oven via the intake pipe is interrupted. To this end, the casting piston is disposed between the casting cavity and the discharge end of the intake pipe. The increased volume in the casting cavity may at the same time be vented to the atmosphere by opening a valve or it may be evacuated via the evacuation arrangement.

It is the principal object of the present invention to avoid gas inclusions in the melt of a vacuum casting machine by simple means.

SUMMARY OF THE INVENTION

In a vacuum-die casting machine comprising a casting mold having stationary and movable mold halves defining therebetween a mold cavity, casting chamber which is in communication with the mold cavity and includes a piston and an evacuation arrangement connectable to the casting chamber for drawing Melt from a melt storage into the casting chamber, a control arrangement is provided for controlling the mold cavity pressure depending on the pressure difference between the mold cavity and a cavity pressure and a counter pressure of the metal melt.

At the beginning of the casting process, the movable mold half is moved toward the stationary mold half by means of an operating device, in particular, a hydraulic operating cylinder. Upon contact between the opposing front edges of the mold halves, or respectively, between the front edge of one mold half and the other mold half with a seal rope disposed on the front side of the other mold half, an air volume is enclosed in the mold cavity. This may result in an excess pressure which may be transmitted from the mold cavity via the casting chamber to the metal melt in the warm-holding oven causing gas inclusions in the metal melt. In order to avoid this, in accordance with the invention, a pressure sensing arrangement is provided by which the pressure in the mold cavity is determined. In addition, a control arrangement is provided via which the pressure in the mold cavity can be controlled. The control arrangement adjusts a melt counter pressure depending on the differential pressure of the mold cavity and the melt counter pressure. The melt counter pressure is the pressure which has to be overcome for gas to be introduced from the mold cavity via the casting chamber into the metal melt. The melt counter pressure is the sum of the hydrostatic pressure between the opening of a suction pipe immersed into the metal melt and the level of the metal melt in the warm holding oven taking into consideration the density of the metal melt. Added to the melt counter pressure is further the pressure to which the metal melt is subjected, generally the atmospheric pressure.

When the communication path between the mold cavity and the metal melt is open, the pressure difference between the mold cavity pressure and the melt counter pressure determines whether the mold cavity pressure reaches the metal melt and causes an air inclusion therein. When the mold cavity pressure is below the melt counter pressure, no air can enter the metal melt in spite of an open flow communication path between the mold cavity and the warm holding oven. A chance of air entering the metal melt exists actually only when the melt, counter pressure is below the metal melt pressure. By way of the setting of the control arrangement, the mold cavity pressure is so controlled that the pressure in the mold cavity will remain below the melt counter-pressure.

This arrangement has the advantage that the flow connection between the mold cavity and the warm holding oven does net have to be interrupted. It is therefore not necessary that the casting piston, which is movably disposed in the casting chamber needs to be moved into a position in which it blocks the flow path. Rather, the casting piston may advantageously remain in a retracted position in which the communication path between the mold cavity and the warm-holding oven is open. This also has the advantage that the casting piston is in a position as needed for the subsequent evacuation procedure for suctioning the metal melt into the casting chamber. The casting piston can remain in the retracted position during the closing of the movable mold half and during the subsequent evacuation procedure. Only after the metal melt has been transported into the casting chamber, the casting piston has to move the melt volume from the casting chamber into the mold cavity by a forward movement.

The control movement of the control arrangement is the control value by which the mold cavity pressure is influenced. As described earlier, the movement of the control arrangement is determined as a function of the pressure difference between the mold cavity pressure and the melt counter pressure. The control signals are generated in a control unit and are supplied to operating arrangement so that it assumes the desired position for achieving the desired mold cavity pressure.

Basically, various operating arrangements may be used for setting the mold cavity pressure. In accordance with an advantageous embodiment, the operating arrangement can be formed by the movable mold half of the casting mold wherein, for the adjustment of the mold cavity pressure, the closing speed of the movable mold half is used. Normally, the movable mold half is moved during the closing procedure with a predetermined speed profile from which however it can be deviated for adjusting the mold cavity pressure. In particular, when the, mold halves, with the seal rope extending around the mold cavity at the front faces between the two mold halves, are engaged, an air volume is enclosed between the mold halves so that, upon further compressing of the movable mold half onto the stationary mold halt, an excess pressure can be, generated in the mold cavity. By reducing the engagement speed dynamically generated pressure peaks in the mold cavity can be avoided. In this way, the mold cavity pressure can be kept below the melt counter-pressure by controlling the closing speed of the movable mold half.

The movable mold half is operated by an actuator whose movement is controlled by control signals of the control unit. The actuator is for example a hydraulic cylinder.

In accordance with another advantageous embodiment, a pressure valve is provided on the mold cavity via which the mold cavity is connected to the evacuation arrangement. The pressure valve is adjustable at least between an open position in which the mold cavity is in communication with the evacuation arrangement and a closed position. In a preferred embodiment, the pressure valve is in the form of a three-way valve which, in addition to the closed position and the open. position in which a communication path to the evacuation arrangement is provided, can be moved to a third position in which the mold cavity is placed into communication with the atmosphere. In this way, an additional setting can be provided in which the mold cavity pressure can be influenced. It is for example possible to keep the three-way valve in the evacuation posit ion or, respectively, to move it to this position when the mold cavity pressure is to be adjusted by the control arrangement. It is also possible as a result to move the three-way valve into a position which provides for communication with the atmosphere when the action for controlling the pressure of the mold cavity is to be adjusted.

The mold cavity pressure is determined by means of a pressure sensing arrangement. The pressure sensing arrangement comprises preferably a pressure sensor, which is arranged in or at the mold cavity and via which the mold cavity pressure can be measured directly or indirectly. However, it is basically also possible to use a measuring value estimator as pressure determining arrangement as which the pressure is for example estimated on the basis of a mathematical model.

In a method for controlling the mold cavity pressure in the mold cavity of a vacuum-die casting machine, a desired pressure in the mold cavity is adjusted as a function of the pressure difference between the actual mold cavity pressure and the melt counter pressure. The mold cavity pressure is controlled in a closed control circuit in which pressure values for the mold cavity are determined and compared with the delivery pressure. Based hereon, an adjustment is performed by the operating arrangement in order to bring the momentary mold cavity pressure to a desired pressure. After the change by the operating arrangement, the pressure in the mold cavity is again determined and, if necessary another adjustment is made. The pressure difference between the mold cavity pressure and the melt counter pressure can be adjusted for example to zero or, respectively, is residual value. If necessary, a negative residual value may be set for safety reasons to ensure that the mold cavity pressure is smaller than the delivery pressure.

All signals, that is, the measuring signals as well as the control signals are processed in the control unit which is assigned to the die casting machine.

Basically, instead of a control arrangement with a closed control circuit, a control arrangement with an open control circuit may be used wherein the mold cavity pressure is not constantly determined but only once within a limited time period and wherein, based on the determined pressure, the mold cavity pressure is adjusted by the operating arrangement.

The control of the mold cavity pressure starts advantageously with the movement of one mold half. This can be determined either by detecting an increase in the mold cavity pressure or, in accordance with another embodiment, dependent on the travel distance in that after a predetermined travel distance of the movable, mold half, the adjustment of the mold cavity pressure is started.

As described above, the mold cavity pressure is advantageously controlled by an adjustment of the closing or respectively, approaching speed of the movable mold half. Additionally or alternatively, it is also possible to use for example a proportional valve as a pressure valve and to ad just the position of the valve body of the proportional valve. By way of the proportional valve, the mold cavity may be in communication with the atmosphere or with the evacuation arrangement.

Further advantages and suitable embodiments of the invention will become more readily apparent from the following description of exemplary embodiments thereof with reference to the accompanying drawings.

DESCRIPTION OF EXEMPLARY EMBODIMENTS

Figure 1:
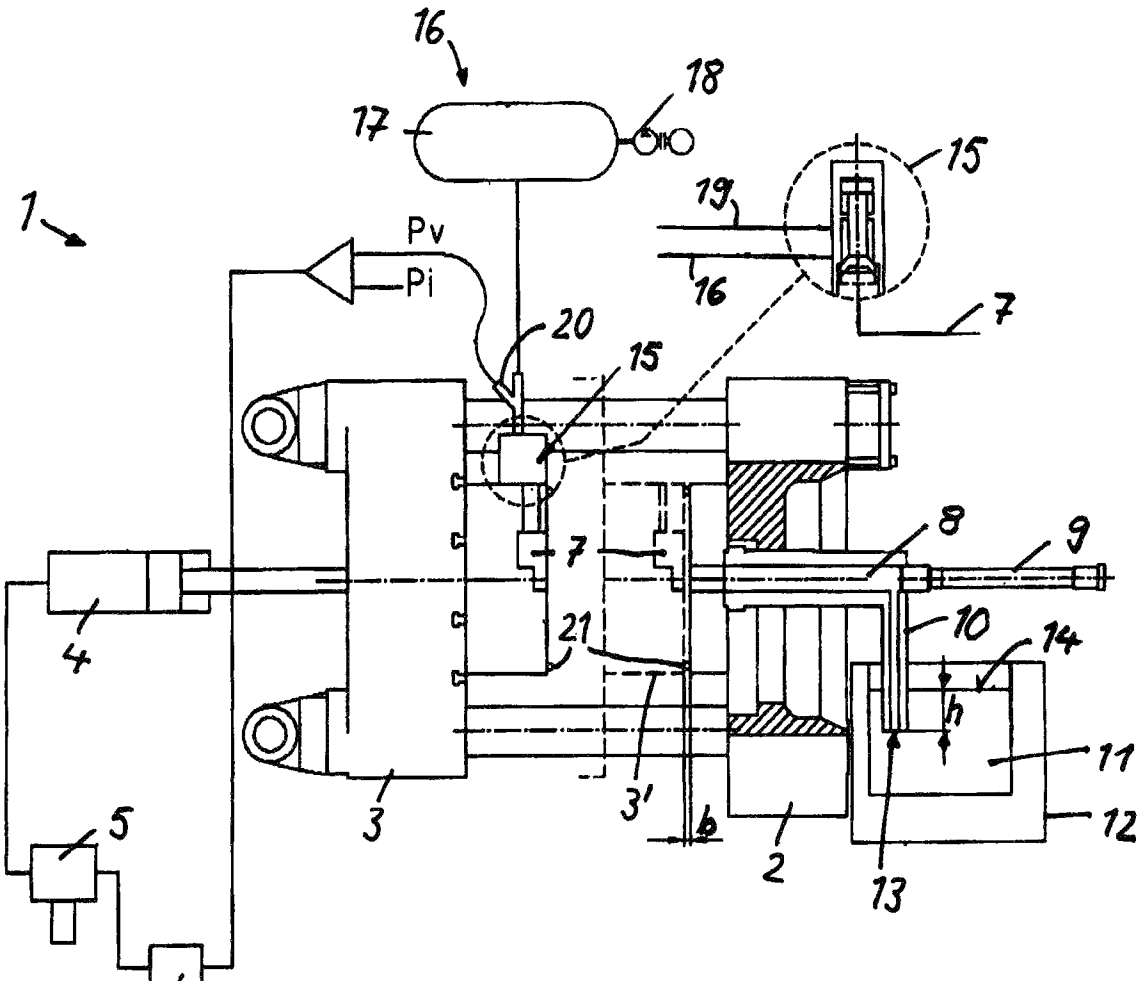
FIG. 1 shows schematically a vacuum casting machine with a three-way valve arranged at a mold cavity formed between two mold halves of the die casting machine.

FIG. 1 shows a vacuum-die casting machine 1 which comprises two mold halves 2, 3 wherein the mold half 2 is stationary and the mold half 3 is movably supported. The mold half 3 is adjustable between a retracted position (3) as shown in solid lines and a position (3') moved toward the stationary mold half and indicated by dashed lines. The movement of the mold half 3 is achieved by an actuator in the form of a hydraulic cylinder 4 to which hydraulic fluid is supplied via a hydraulic valve 5. The hydraulic valve 5 is controlled by control signals of a control arrangement 6.

Between the mold halves 2, 3, a casting or, respectively, molding cavity 7 for receiving a metal melt is enclosed. The mold cavity 7 is in flow communication with a casting chamber 8 in which a casting piston. 9 is movably supported. The casting chamber 8 is connected to a metal melt 11 disposed in a warm-holding oven 12 via a suction pipe 10. The suction pipe 10 extends so far into the metal melt 11 that the suction pipe end opening 13 is below the melt level 14 of the metal melt 11. The gas pressure needed to introduce gas into the metal melt is determined by the hydrostatic pressure and the ambient pressure on the melt surface 14, wherein the hydrostatic pressure is obtained by a multiplication, of the level difference h between the melt level 14 and the end opening of the 13 by the density of the metal melt.

The mold cavity 7 is provided with a three-way valve 15, which, as shown in the enlarged representation in FIG. 1, is connected in a first position to an evacuation arrangement 16, which includes a vacuum Lank 17 and a vacuum pump 18. Furthermore, in a further position which is indicated by a reference, number 19, the three-way valve 15 is connected to the atmosphere. At the opposite side, the vacuum valve 15 is connected to the mold cavity 7.

At the three way valve, furthermore, a pressure sensor 20 is arranged via which the mold cavity pressure $p_v$ can be measured. The measured mold cavity pressure $p_v$ is supplied, together with the melt pressure $p_1$, as input signal to the control unit 6 in which, depending on the supplied signals, control signals for the adjustment of the hydraulic valve 5 and, respectively, the hydraulic cylinder 4 are generated for controlling the closing speed of the movable mold half 3. By means of the control signals of the control unit 6 furthermore the three-way valve 15 may be switched. In addition also the movement of the casting piston 9 is controlled via control signals of the control unit 6.

During the closing movement, the movable mold half 3 approaches the stationary mold half 2. At the front edge of the movable mold half 3, a circumferential seal 21 in the form of a seal rope is arranged so that it projects from the front edge of the movable mold half 3. As soon as the seal rope 21 contacts the opposite front edge of the stationary mold half 2, an excess air volume is enclosed in the mold cavity 7. The projection of the seal rope 21 beyond the front edge of the movable mold half 3 is indicated by the distance b, that is the seal rope 21 comes into contact with the front edge of the stationary mold half 2 as soon as the distance between the mold halves becomes smaller than the distance b.

Figure 2:
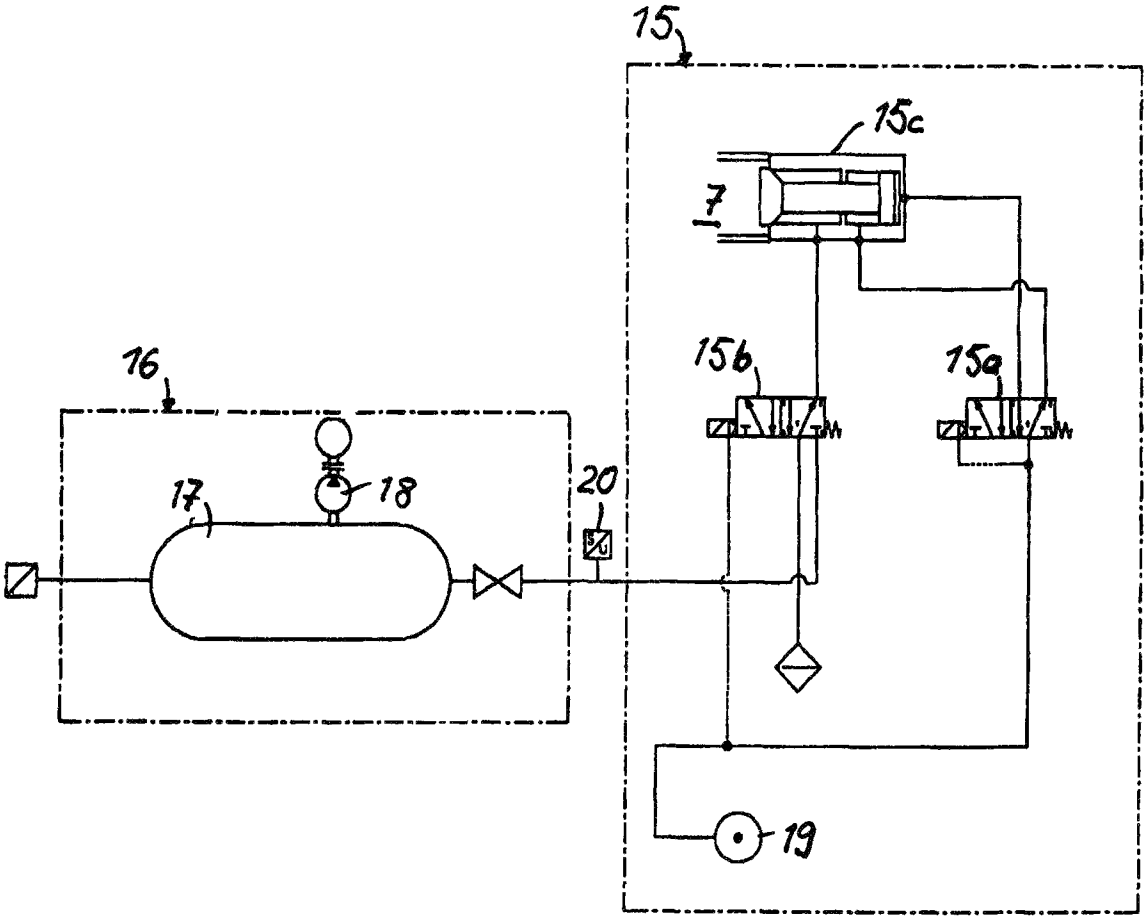
FIG. 2 is an enlarged view of the three-way valve in a position in which an evacuation arrangement is disconnected from the mold cavity and the mold cavity is in communication with the atmosphere.
Figure 3:
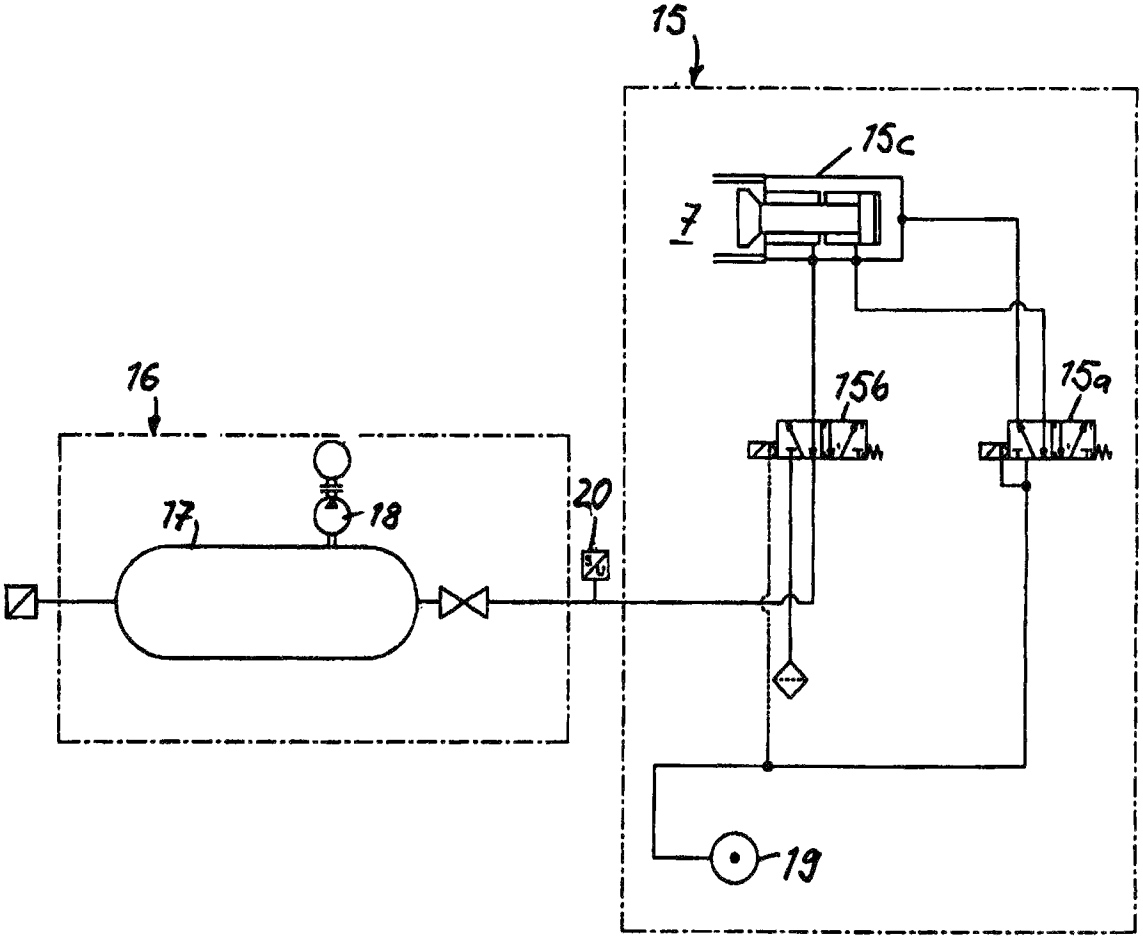
FIG. 3 shows the three-way valve in position in which it is connected to the evacuation arrangement.

FIG. 2 shows the three-way valve 15 during the closing procedure of the movable mold half 3. FIG. 3 shows three-way valve in a position in which it is connected to the evacuation arrangement 16. Up to the point where the seal rope 21 is in contact with the facing front edge of the stationary mold half 2 the closing procedure is performed at high speed. The three-way valve 15 comprises three individual valves 15*a*, 15*b*, 15*c*, of which the individual valve together with the individual valve 15*c* controls the connection between the mold cavity 7 and the atmosphere 19, and the individual valve 15*b* in connection with the individual valve 15*c* controls the flow connection between the mold cavity 7 and the evacuation arrangement 16. During the closing movement of the movable mold half 3, the individual valve 15*b* is switched off, that is closed, so that there is no flow connection between the mold cavity 7 and the evacuation arrangement 16. The individual valve 15*a* is switched open so as to provide for a flow connection between the atmosphere 19 and an area of the individual valve 15*c* remote from the mold cavity 7. The individual valve 15 is closed.

When a contract is established between the seal rope 21 and the facing front edge of the stationary mold half 2, the individual valve 15*c*. is opened and at the same time also the individual valve 15*b* is moved to the opening position so that the mold cavity 7 is connected to the evacuation arrangement 16. Via the pressure sensor 20, the momentary pressure in the mold cavity 7 is measured. Depending on the height of the pressure, the further closing speed of the movable mold half 3 is controlled by control signals of the control unit 6. The closing speed is so adjusted that the differential pressure $\Delta p$ between the measured mold cavity pressure $p_v$ and the melt pressure $p_1$ which is also measured, does not exceed a certain value. The adjustment is performed especially in such a way that the mold cavity pressure $p_v$ is always smaller than the melt pressure $p_1$ whereby it is ensured that the enclosed as volume in the mold cavity 7 cannot be driven is the open connection, the casting chamber 8 and the suction pipe 10 into the melt 11 in the warm holding oven 12. In this way, the turbulences and gas inclusions in the melt 11 are prevented.

In addition to the adaptation of the closing speed of the movable mold nail 3, the evacuation of the gas volume via the evacuation arrangement 16 is achieved.

During the closing procedure of the movable mold half 3 up to the establishment of a contact between the front edges of the two mold halves, the casting piston 9 remains in the retracted position as shown in FIG. 1 in which flow communication between the mold cavity 7 via the casting chamber 8 and the suction pipe 10 and also the metal melt 11 in the warm holding oven exists. The described control is established in order to prevent gas from flowing into the melt 11 during the closing procedure.

After the closing procedure is completed, a vacuum can be generated in the mold cavity via a connection with the evaluation arrangement 16 so that melt 11 is drawn into the casting chamber 8 via the suction pipe 10. Subsequently, the melt is moved from the casting chamber 8 into the mold cavity 7 by forward movement of the casting piston 9.

What is claimed is:

1. A method for adjusting the mold cavity pressure ($p_v$) of a vacuum-die casting machine (1) comprising a casting mold having a stationary mold half (2) and a movable mold half (3) between which a mold cavity (7) is formed, a casting chamber (8) which is in communication with the mold cavity (7) and which include a casting piston (9) movably disposed in the casting chamber (8), a warm holding oven (12) for containing a metal melt (11) connected to the casting chamber (8) for supplying metal melt thereto, an evacuation arrangement (16) for generating a vacuum in the mold cavity (7), a pressure determining arrangement for determining a pressure ($p_v$) in the mold cavity (7) and at least one control arrangement for adjusting the mold cavity pressure ($p_v$) depending on the pressure difference ($\Delta_p$) between the mold cavity pressure ($p_v$) and a melt counter pressure ($p_1$) of the metal melt (11), said method comprising the step of:

determining the mold cavity pressure $p_v$ and adjusting the mold cavity pressure ($p_v$) depending on a pressure difference ($\Delta_p$) between the mold cavity pressure ($p_v$) and a melt counter pressure ($p_1$) of the metal melt (11) to a predetermined value.

2. The method according to claim 1, wherein the adjustment of the mold cavity pressure ($p_v$) is performed in a closed control circuit.

3. The method according to claim 1, wherein the mold cavity pressure ($p_v$) adjustment starts with the engagement of one mold half (2, 3) with a seal (21) arranged at the other mold half (3, 2).

4. The method according to claim 1, wherein the closing speed of the movable mold half (3) is variably controlled.

5. The method according to claim 1, during the adjustment of the pressure in the mold cavity, a pressure valve provided at the mold cavity is opened.

* * * * *